US011688364B2

(12) United States Patent
Paudel et al.

(10) Patent No.: US 11,688,364 B2
(45) Date of Patent: Jun. 27, 2023

(54) SYSTEMS AND METHODS FOR TILE BOUNDARY COMPENSATION

(71) Applicant: Apple Inc., Cupertino, CA (US)

(72) Inventors: Hari P Paudel, Milpitas, CA (US); Chaohao Wang, Sunnyvale, CA (US); Hopil Bae, Palo Alto, CA (US); Mahdi Farrokh Baroughi, Santa Clara, CA (US); Wei Chen, Palo Alto, CA (US); Wei H Yao, Palo Alto, CA (US); Seung B Rim, Pleasanton, CA (US); Sunmin Jang, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/714,805

(22) Filed: Apr. 6, 2022

(65) Prior Publication Data

US 2022/0375427 A1 Nov. 24, 2022

Related U.S. Application Data

(60) Provisional application No. 63/190,634, filed on May 19, 2021.

(51) Int. Cl.
*G09G 5/10* (2006.01)

(52) U.S. Cl.
CPC ..... *G09G 5/10* (2013.01); *G09G 2300/026* (2013.01); *G09G 2320/0686* (2013.01); *G09G 2340/12* (2013.01); *G09G 2354/00* (2013.01); *G09G 2360/16* (2013.01)

(58) Field of Classification Search
CPC ..... G09G 5/10; G09G 2300/026; G09G 2320/0686; G09G 2340/12; G09G 2354/00; G09G 2360/16
See application file for complete search history.

(56) References Cited

U.S. PATENT DOCUMENTS

| | | | | |
|---|---|---|---|---|
| 6,184,953 | B1 | 2/2001 | Greene | |
| 6,330,111 | B1 * | 12/2001 | Myers | G09F 9/33 359/599 |
| 9,274,369 | B1 * | 3/2016 | Lee | G02B 6/0005 |
| 11,056,067 | B2 | 7/2021 | Jun | |
| 2004/0164667 | A1 * | 8/2004 | Dedene | H01L 27/3218 313/500 |
| 2013/0328948 | A1 * | 12/2013 | Kunkel | G09G 3/20 345/87 |
| 2014/0056003 | A1 * | 2/2014 | Frattalone | G09F 9/3026 362/249.06 |
| 2014/0133749 | A1 * | 5/2014 | Kuo | H04N 5/213 382/167 |
| 2015/0356344 | A1 * | 12/2015 | Yamanashi | G06K 9/00 382/103 |

(Continued)

*Primary Examiner* — Antonio Xavier
(74) *Attorney, Agent, or Firm* — Fletcher Yoder P.C.

(57) ABSTRACT

An electronic device may display image content via a tile-based display by controlling light emission from display pixels of the tile-based display. Based on image data associated with the image content, a processing circuitry of the tile-based display may receive a potential tile boundary. The processing circuitry may resample the image data based on geometry of the tile boundary and positions of the display pixels on the tile-based panel. After resampling the image data, the processing circuitry may adjust gain of the tile boundary display pixels according to a gain mask to compensate for the tile boundary.

21 Claims, 9 Drawing Sheets

(56) References Cited

U.S. PATENT DOCUMENTS

| | | | | |
|---|---|---|---|---|
| 2017/0134611 | A1* | 5/2017 | Thomas | H04N 1/19594 |
| 2019/0019474 | A1* | 1/2019 | Jun | G06F 3/1446 |
| 2019/0355316 | A1* | 11/2019 | Ji | G09G 3/36 |
| 2020/0193943 | A1* | 6/2020 | Iversen | G09G 5/42 |
| 2020/0241828 | A1* | 7/2020 | Noyelle | G09G 3/3208 |
| 2020/0251048 | A1 | 8/2020 | Im | |
| 2021/0272528 | A1* | 9/2021 | Goto | G02F 1/133601 |
| 2022/0005438 | A1 | 1/2022 | Swatek | |
| 2022/0051641 | A1* | 2/2022 | Park | H04N 5/2257 |
| 2022/0223080 | A1* | 7/2022 | Furihata | G09G 5/10 |

* cited by examiner

SYSTEMS AND METHODS FOR TILE BOUNDARY COMPENSATION

CROSS-REFERENCE TO RELATED APPLICATIONS

This application claims priority to U.S. Provisional Application Ser. No. 63/190,634, filed May 19, 2021, entitled "Systems and Methods for Tile Boundary Compensation," the disclosure of which is incorporated by reference in its entirety for all purposes.

SUMMARY

The present disclosure relates generally to display panels (e.g., tile-based displays), and more particularly, to compensating for tile boundaries in tile-based displays.

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Display panels on electronic displays may display images that present visual representations of information. Accordingly, numerous electronic systems—such as computers, mobile phones, portable media devices, tablets, televisions, virtual-reality headsets, and vehicle dashboards, among many others—often include or use display panels. In any case, a display panel may generally display an image by actively controlling light emission from its display pixels. By adjusting the brightness of different color components of the display pixels, a variety of different colors may be generated that collectively produce a corresponding image.

Different display pixels may emit different colors. For example, some of the display pixels may emit red light, some may emit green light, and some may emit blue light. Thus, the display pixels may be driven to emit light at different brightness levels to cause a user viewing the display to perceive an image formed from different colors of light. The display pixels may also correspond to hue and/or luminance levels of a color to be emitted and/or to alternative color combinations, such as combinations that use cyan (C), magenta (M), or the like. In some embodiments, a display pixel may include a group of display sub-pixels. However, as used herein, a display sub-pixel will refer to a display pixel.

Some display panels may be formed by combining multiple tiles of display panels. Because it may be difficult to always position each tile in perfect alignment with one another, the display panel could experience alignment errors, rotational errors, or gap errors, which may cause tile boundaries to appear on the display panels when images are displayed on the display panels. As used herein, a tile-based display may include at least tiles that are arranged in a 2D array.

When assembling a set of tiles of the tile-based display as a 2D array, the tile-based display may experience alignment errors, rotational errors, or gap errors. In particular, large tile-based displays may be prone to shifts or gaps between adjacent tiles (e.g., adjacent tiles that are closer together than a suitable distance or adjacent tiles that are farther apart than a suitable distance). Such alignment, rotation, and gap issues may cause tile boundaries to appear on the tile-based display when images are displayed on the tile-based display. As such, tile boundaries, display artifacts, and other visual errors may disrupt the desired effect or experience for users when viewing images on tile-based displays. Further, replacing tile-based display panels due to tile boundaries may be costly, time consuming, and inefficient for manufacturers of the tile-based display panels. However, reducing visibility or appearance of potential tile boundaries or correcting for tile boundaries may be desirable to manufacturers of the tile-based display and may improve user experience when viewing displayed images.

Accordingly, the present disclosure provides techniques for compensating or correcting for tile boundaries on a tile-based display panel. In some embodiments, the tile-based display panel may be part of an electronic device. In other embodiments, the tile-based display panel may be communicatively coupled to the tile-based display. Processing circuitry (e.g., a processing circuitry, image processing circuitry, image compensation circuitry) of the electronic device may receive image data (e.g., image data) associated with displaying image content on the tile-based display. The image data may indicate potential shifts, gaps, rotational errors, alignment errors, and the like in between tiles (e.g., along tile boundaries) of the tile-based display panel.

Because the image data may be calculated by the processing circuitry based on a computer algorithm, calculated locations of the display pixels according to the image data may slightly vary compared to actual locations of the display pixels on the tile-based display. To account for this variance and ensure that the calculated locations of the display pixels according the image data match the actual locations of the display pixels on the tile-based display, the processing circuitry may resample the image data, in some embodiments. For example, according to the image data, a particular location on a tile-based display may include four display pixels. However, the actual number of pixels at the particular location of the tile-based display may be three display pixels. As such, the image data may be resampled to account for the actual number of pixels at the particular location on the tile-based display. As used herein, resampling of image data may involve changing (e.g., increasing, decreasing) the calculated number of display pixels at various locations on the tile-based display.

In some embodiments, the processing circuitry may generate the image data as an XY array. If the tile-based display is arranged as a hexagonal grid, calculated locations of the display pixels based on the XY array may vary from the actual locations of the display pixels on the hexagonal grid of the tile-based display. As such, the processing circuitry may resample the image data to account for the actual locations of the display pixels on the hexagonal grid. However, in some embodiments, the processing circuitry may not resample the image data, thereby saving processing power. For example, if a pixel arrangement of the tile-based display was a square grid, then the variance between the calculated locations of the display pixels according to the XY array and the actual locations of the display pixels on the square grid may be negligible.

To compensate for tile boundaries, the processing circuitry may perform any number or type of corrections. For example, the processing circuitry may perform a first order correction by adjusting luminance of display pixels along a tile boundary (e.g., tile boundary display pixels) according to a gain mask based on a distance between the display pixels along the tile boundary. When a distance between adjacent tile boundary display pixels is greater than a distance between adjacent non-tile boundary display pixels (e.g., the gap between tiles at the tile boundary may appear larger to a viewer compared to gap between tiles not at the tile boundary), a dark line may appear at the tile boundary, the tile boundary display pixels may appear dimmer than the non-tile boundary display pixels despite having the same level of brightness as the non-tile boundary display pixels because they are farther apart, or both. Accordingly, to compensate for a larger gap between at least two tiles at the tile boundary and reduce visibility of the dark line, the processing circuitry may perform a first order correction by increasing gain (e.g., luminance) of the tile-boundary display pixels (e.g., display pixels along a tile boundary between a first tile and a second tile) according to a gain mask or a point spread function. As used herein, a gain mask indicates a target luminance distributed to various display pixels to compensate for display pixels that appear dimmer or brighter than average based on how close or far apart the display pixels are from each other along the tile boundary. By increasing the gain of the tile-boundary display pixels, the tile boundary may no longer be apparent to a viewer, or the gap may appear to be smaller on the tile-based display.

In some embodiments, the processing circuitry may also perform a second order correction according to the gain mask or the point spread function (e.g., 2D point spread function). The point spread function involves the distribution of luminance to surrounding display pixels from a point or location on the tile-based panel. Based on a luminance of a display pixel along the tile boundary, luminance of other display pixels adjacent to the display along the tile boundary may be adjusted according to the point spread function. For example, if the luminance of the tile-boundary display pixels is increased, the processing circuitry may reduce the gain at non-tile boundary display pixels to account for increased luminance at the tile-boundary display pixels due to the first order correction. The non-tile boundary display pixels are display pixels that surround the display pixels along the tile boundary.

When a distance between adjacent tile boundary display pixels is less than a specified distance between adjacent non-tile boundary display pixels (e.g., the gap between tiles at the tile boundary is smaller compared to gap between tiles not at the tile boundary), a bright line may appear at the tile boundary, the tile boundary display pixels may appear brighter than the non-tile boundary display pixels despite having the same level of brightness as the non-tile boundary display pixels because they are closer together, or both. Accordingly, to compensate for a smaller gap between tiles at the tile boundary and reduce visibility of the bright line, the processing circuitry may perform a first order correction by decreasing gain at the tile-boundary display pixels based on a gain mask. In additional and/or alternative embodiments, the processing circuitry may perform a second order correction. For example, if the luminance of the tile-boundary display pixels is decreased, the processing circuitry may increase the gain at non-tile boundary display pixels to account for the decreased luminance at the tile-boundary display pixels due to the first order correction (e.g., may apply a point spread function).

The gain mask may be calculated based on respective locations of the display pixels on the display panel, a pixel arrangement of the display panel, and the like. As used herein, the pixel arrangement may indicate a layout or shape of a grid of display pixels of the display panel. Non-limiting examples of pixel arrangements may include hexagonal grids, square grids, and rectangular grids.

Compensating for tile boundary variations may reduce the visibility or appearance of the tile boundaries or other visual artifacts on the tile-based display due to uneven distances between tiles. In some cases, the total luminance associated with the image data may not change despite resampling the image data and/or compensating for tile boundaries.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Figure 1:
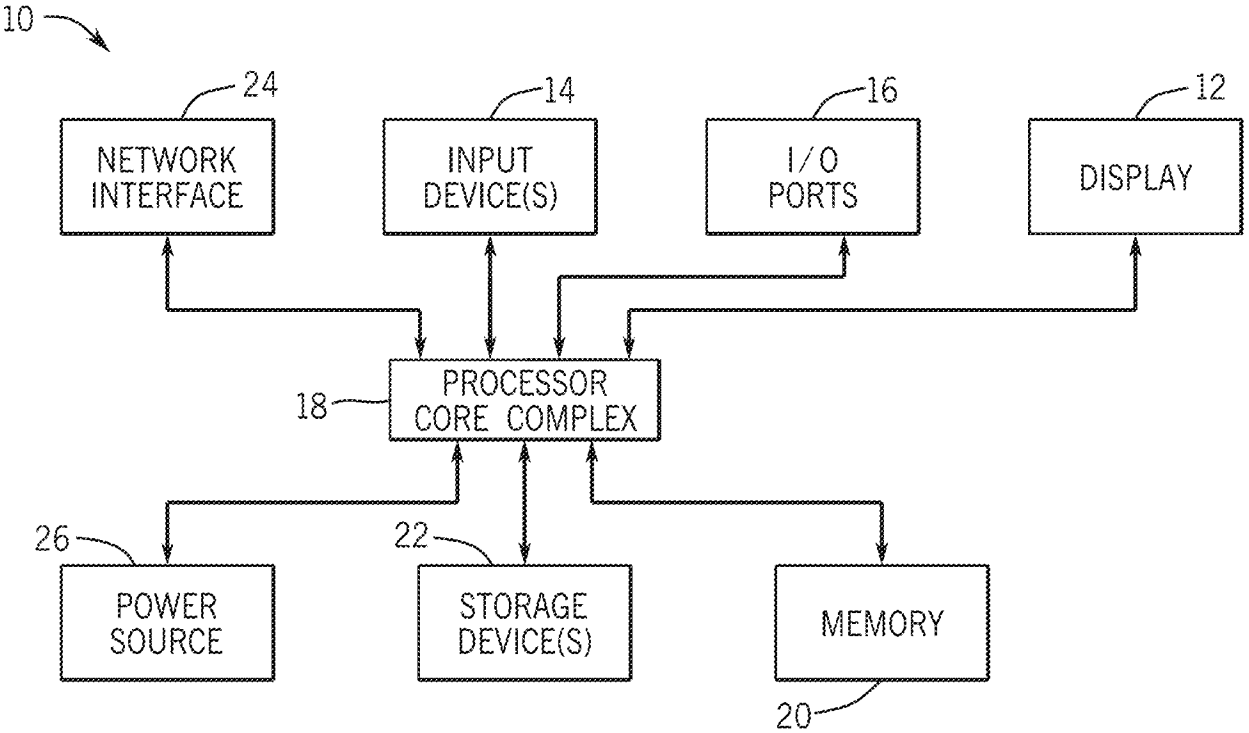
FIG. 1 is a block diagram of an electronic device with an electronic display, in accordance with an embodiment of the present disclosure.

With the preceding in mind and to help illustrate, an electronic device 10 including an electronic display 12 (e.g., display panel) is shown in FIG. 1. As is described in more detail below, the electronic device 10 may be any suitable electronic device, such as a computer, a mobile phone, a portable media device, a tablet, a television, a virtual-reality headset, a vehicle dashboard, and the like. Thus, it should be noted that FIG. 1 is merely one example of a particular implementation and is intended to illustrate the types of components that may be present in an electronic device 10.

The electronic display 12 may be any suitable electronic display. For example, the electronic display 12 may include a self-emissive pixel array having an array of one or more of self-emissive display pixels. The electronic display 12 may include any suitable circuitry to drive the self-emissive display pixels, including for example row driver or column drivers (e.g., display drivers). The self-emissive display pixels may include any suitable light emitting element, such as an LED, one example of which is an OLED. However, any other suitable type of display pixel, including non-self-emissive display pixels (e.g., liquid crystal as used in liquid crystal displays (LCDs), digital micromirror devices (DMD) used in DMD displays) may also be used.

The electronic device 10 includes the electronic display 12, one or more input devices 14, one or more input/output (I/O) ports 16, a processor core complex 18 having one or more processing circuitry(s) or processing circuitry cores, local memory 20, a main memory storage device 22, a network interface 24, and a power source 26 (e.g., power supply). The various components described in FIG. 1 may include hardware elements (e.g., circuitry), software elements (e.g., a tangible, non-transitory computer-readable medium storing executable instructions), or a combination of both hardware and software elements. It should be noted that the various depicted components may be combined into fewer components or separated into additional components. For example, the local memory 20 and the main memory storage device 22 may be included in a single component.

In some embodiments, the processor core complex 18 may include imaging processing circuitry to process image data based at least in part on compensation parameters (e.g., gain mask) before processed image data is used to display corresponding image content on the electronic display 12. To compensate for tile boundaries or gap errors on the electronic display 12, the image processing circuity may process the image data based on a gain mask.

The processor core complex 18 is operably coupled with local memory 20 and the main memory storage device 22. Thus, the processor core complex 18 may execute instruction stored in local memory 20 or the main memory storage device 22 to perform operations, such as generating or transmitting image data. As such, the processor core complex 18 may include one or more general purpose microprocessors, one or more application specific integrated circuits (ASICs), one or more field programmable logic arrays (FPGAs), or any combination thereof.

In addition to instructions, the local memory 20 or the main memory storage device 22 may store data to be processed by the processor core complex 18. Thus, the local memory 20 and/or the main memory storage device 22 may include one or more tangible, non-transitory, computer-readable media. For example, the local memory 20 may include random access memory (RAM) and the main memory storage device 22 may include read-only memory (ROM), rewritable non-volatile memory such as flash memory, hard drives, optical discs, or the like.

The network interface 24 may communicate data with another electronic device or a network. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, or a wide area network (WAN), such as a 4G, Long-Term Evolution (LTE), or 5G cellular network. The power source 26 may provide electrical power to one or more components in the electronic device 10, such as the processor core complex 18 or the electronic display 12. Thus, the power source 26 may include any suitable source of energy, such as a rechargeable lithium polymer (Li-poly) battery or an alternating current (AC) power converter. The I/O ports 16 may enable the electronic device 10 to interface with other electronic devices. For example, when a portable storage device is connected, the I/O port 16 may enable the processor core complex 18 to communicate data with the portable storage device.

The input devices 14 may enable user interaction with the electronic device 10, for example, by receiving user inputs via a button, a keyboard, a mouse, a trackpad, or the like. The input device 14 may include touch-sensing components in the electronic display 12. The touch sensing components may receive user inputs by detecting occurrence or position of an object touching the surface of the electronic display 12.

In addition to enabling user inputs, the electronic display 12 may include a display panel with one or more display pixels. The electronic display 12 may control light emission from the display pixels to present visual representations of information, such as a graphical user interface (GUI) of an operating system, an application interface, a still image, or video content, by displaying frames of image data. To display images, the electronic display 12 may include display pixels implemented on the display panel. The display pixels may represent sub-pixels that each control a luminance of one color component (e.g., red, green, or blue for an RGB pixel arrangement or red, green, blue, or white for an RGBW arrangement).

The electronic display 12 may display an image by controlling light emission from its display pixels based on pixel or image data associated with corresponding image pixels (e.g., points) in the image. In some embodiments, pixel or image data may be generated by an image source, such as the processor core complex 18, a graphics processing unit (GPU), or an image sensor. Additionally, in some embodiments, image data may be received from another electronic device 10, for example, via the network interface 24 and/or an I/O port 16. Similarly, the electronic display 12 may display frames based on pixel or image data generated by the processor core complex 18, or the electronic display 12 may display frames based on pixel or image data received via the network interface 24, an input device, or an I/O port 16.

Figure 2:
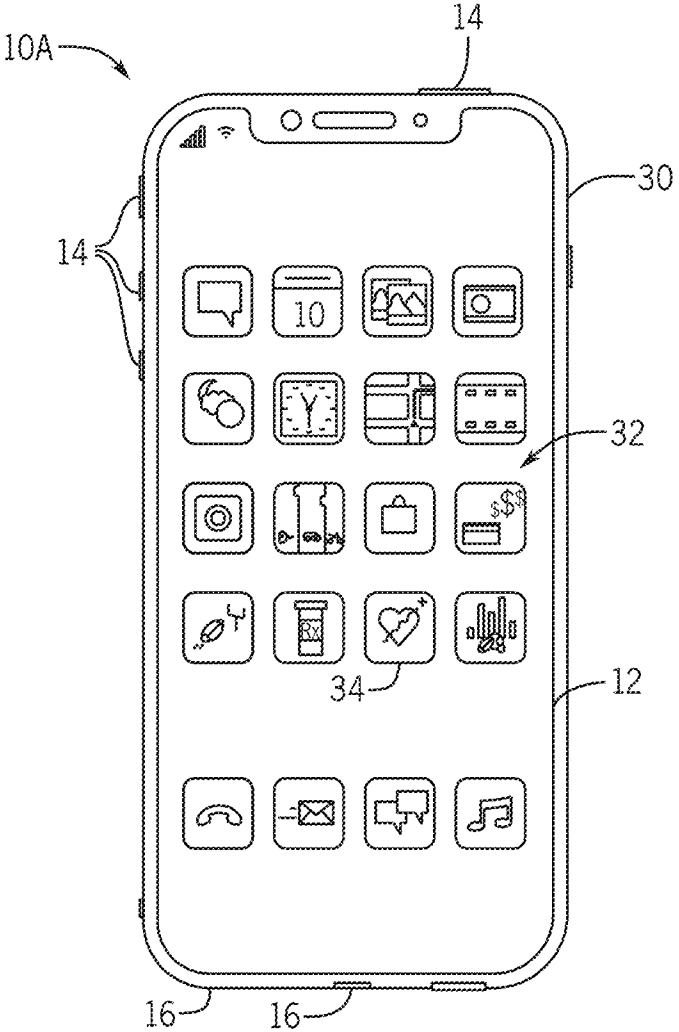
FIG. 2 is an example of the electronic device of FIG. 1, in accordance with an embodiment of the present disclosure.

The electronic device 10 may be any suitable electronic device. To help illustrate, an example of the electronic device 10, a handheld device 10A, is shown in FIG. 2. The handheld device 10A may be a portable phone, a media player, a personal data organizer, a handheld game platform, or the like. For illustrative purposes, the handheld device 10A may be a smart phone, such as any IPHONE® model available from Apple Inc.

The handheld device 10A includes an enclosure 30 (e.g., housing). The enclosure 30 may protect interior components from physical damage or shield them from electromagnetic interference, such as by surrounding the electronic display 12. The electronic display 12 may display a graphical user interface (GUI) 32 having an array of icons. When an icon 34 is selected either by an input device 14 or a touch-sensing component of the electronic display 12, an application program may launch.

The input devices 14 may be accessed through openings in the enclosure 30. The input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, or toggle between vibrate and ring modes.

Figure 3:
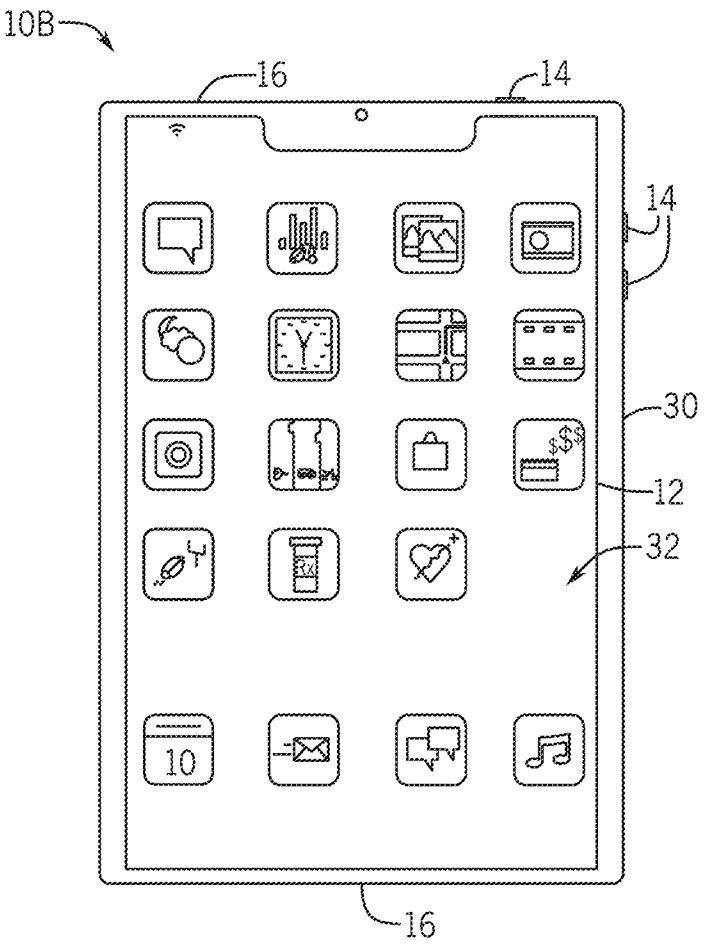
FIG. 3 is another example of the electronic device of FIG. 1, in accordance with an embodiment of the present disclosure.
Figure 4:
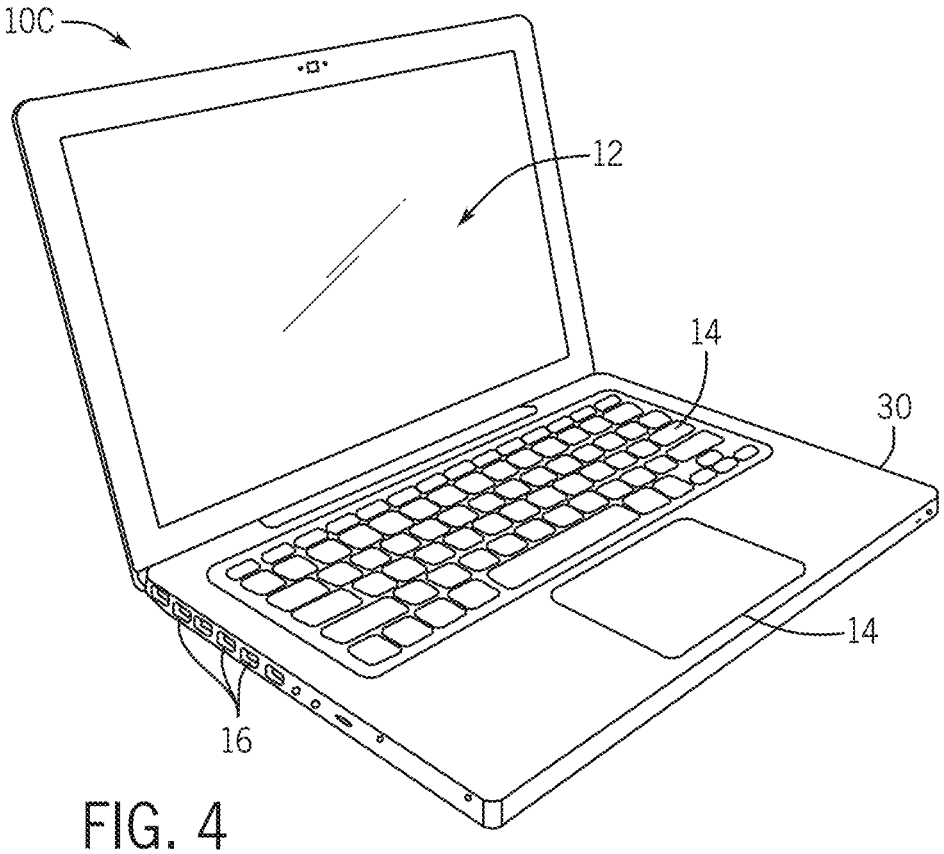
FIG. 4 is another example of the electronic device of FIG. 1, in accordance with an embodiment of the present disclosure.
Figure 5:
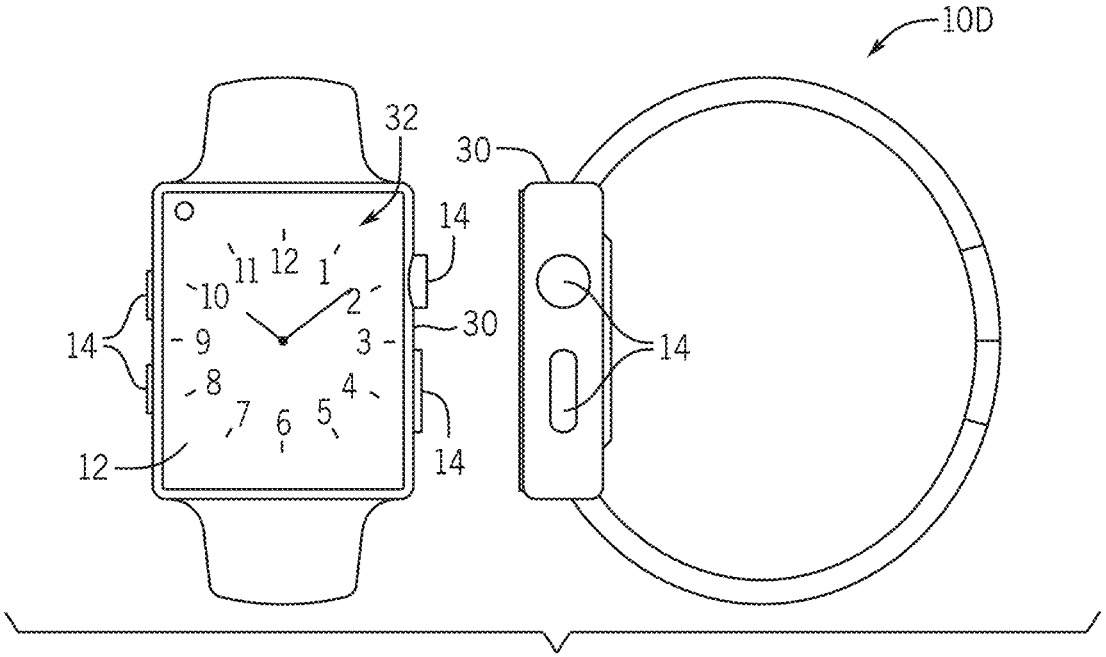
FIG. 5 is another example of the electronic device of FIG. 1, in accordance with an embodiment of the present disclosure.

Another example of a suitable electronic device 10, specifically a tablet device 10B, is shown in FIG. 3. The tablet device 10B may be any IPAD® model available from Apple Inc. A further example of a suitable electronic device 10, specifically a computer 10C, is shown in FIG. 4. For illustrative purposes, the computer 10C may be any MACBOOK® or IMAC® model available from Apple Inc. Another example of a suitable electronic device 10, specifically a watch 10D, is shown in FIG. 5. For illustrative purposes, the watch 10D may be any APPLE WATCH® model available from Apple Inc. As depicted, the tablet device 10B, the computer 10C, and the watch 10D each also includes an electronic display 12, input devices 14, I/O ports 16, and an enclosure 30. The electronic display 12 may display a GUI 32. Here, the GUI 32 shows a visualization of a clock. When the visualization is selected either by the input device 14 or a touch-sensing component of the electronic display 12, an application program may launch, such as to transition the GUI 32 to presenting the icons 34 discussed in FIGS. 2 and 3.

Figure 6:
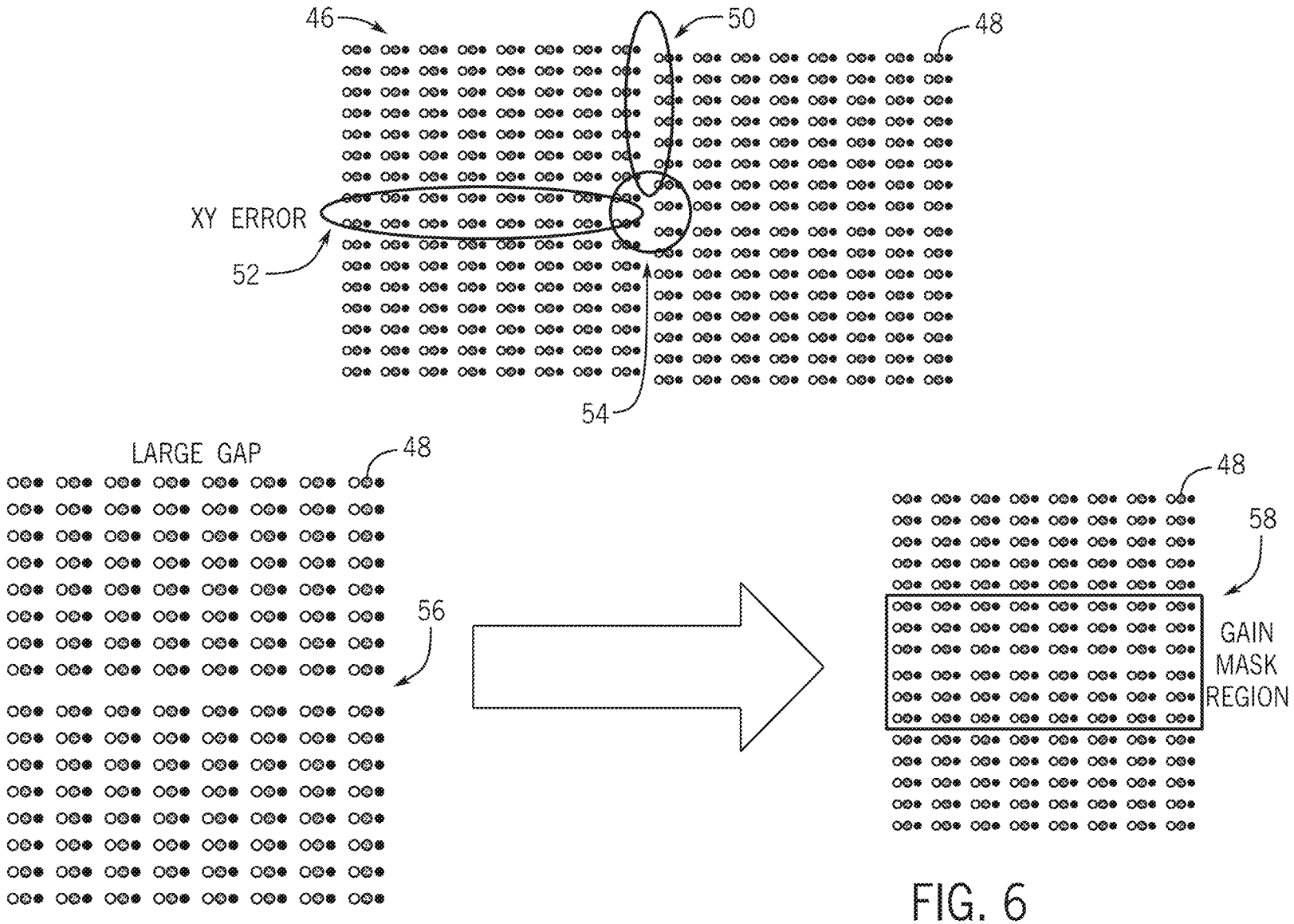
FIG. 6 is a schematic illustration of an example gain mask to correct a gap error on the electronic display of FIG. 1, in accordance with an embodiment of the present disclosure.

With the foregoing in mind, FIG. 6 is a schematic illustration of an example gain mask to correct a gap error on the electronic display 12. As mentioned above, the electronic display 12 may include a matrix of display pixels. Different display pixels (e.g., display sub-pixel) 48 may emit different colors (e.g., green light, blue light, red light). The electronic display 12 may display an image by actively controlling light emission from difference the display pixels 48 based on image data indicative of target luminance (e.g., brightness level or gray level) of the display pixels 48 in the image. In some embodiments, the electronic display 12 may include a tile-based display 46.

As mentioned above, the tile-based display 46 may include at least two or more tiles that are arranged in a 2D array. Because it may be difficult to always position each tile in perfect alignment with one another, the tile-based display 46 could experience alignment errors, rotational errors, or gap errors (e.g., a gap between adjacent tiles is smaller than a suitable distance or a gap between adjacent tiles is larger than a suitable distance), which may cause tile boundaries to appear on the tile-based display 46 when images are displayed on the tile-based display 46. Examples of gaps on the tile-based display 46 may be related to an X-error, a Y-error, an XY-error, and the like. For example, as illustrated in FIG. 6, gap 50 is a vertical-based gap or related to a Y-error, where the display pixels 48 between tiles are farther apart than a specified (e.g., average) distance, resulting in a tile boundary that is wider than expected. Gap 52 is a horizontal-based gap or related to an X-error, where the display pixels 48 between tiles are also farther apart than a specified (e.g., average) distance. Further, gap 54 is related to an XY-error, where the distances between tiles in both the horizontal and vertical directions are greater than specified (e.g., average) horizontal and vertical distances.

Tile boundaries (e.g., gap 50, gap 52, gap 54) may be identified during manufacture, and location of the display pixels 48 at the tile boundaries as well as distances between the display pixels 48 at the tile boundaries may be stored in memory accessible to image processing circuitry. During manufacture of the tile-based display 46, measurements of the distances between display pixels 48 may be obtained by analyzing an image captured of the tile-based display 46. The image processing circuitry may be communicatively coupled to the tile-based display 46. Based on the locations of the display pixels 48 at the tile boundary as well as distances between the display pixels 48 at the tile boundaries, a gain mask (e.g., gain mask 58) may be calculated during manufacture to calibrate the gain (e.g., increase gain, decrease gain) of the display pixels 48 at the tile boundary to achieve a reduced gap. Further, the gain of the display pixels 48 that are not along the tile boundary may also be adjusted according to the gain mask, as discussed in detail below. In some embodiments, the gain of the display pixels 48 along the tile boundary as well as the gain of the display pixels that are not along the tile boundary may be calibrated according to a point spread function. The point spread function involves the distribution of luminance (e.g., gain) to surrounding display pixels from a point or location (e.g., display pixels 48 along the tile boundary). The gain mask or calibration information of the display pixels 48 according to the point spread function may also be stored in memory accessible to the image processing circuitry.

The image processing circuitry may acquire the gain mask or the calibration information of the display pixels 48 according to the point spread function from memory to correct for the tile boundary. The gain mask may be based on respective locations of the display pixels on the tile-based display 46, the pixel arrangement of the tile-based display 46, and the like. For example, to correct for a large horizontal based gap 56 (e.g., X-error) that resulted in a visible tile boundary, the image processing circuitry may adjust the luminance of tile boundary display pixels and/or non-tile boundary display pixels near the large horizontal based gap 56 according to the gain mask 58. By adjusting the luminance of display pixels according the gain mask 58, the tile boundary may appear less visible or the large horizontal based gap 56 may appear smaller. In some embodiments, based on the gain mask, visibility of the tile boundary may be reduced by, for example, 50%, 80%, 90%, or 100%.

Figure 7:
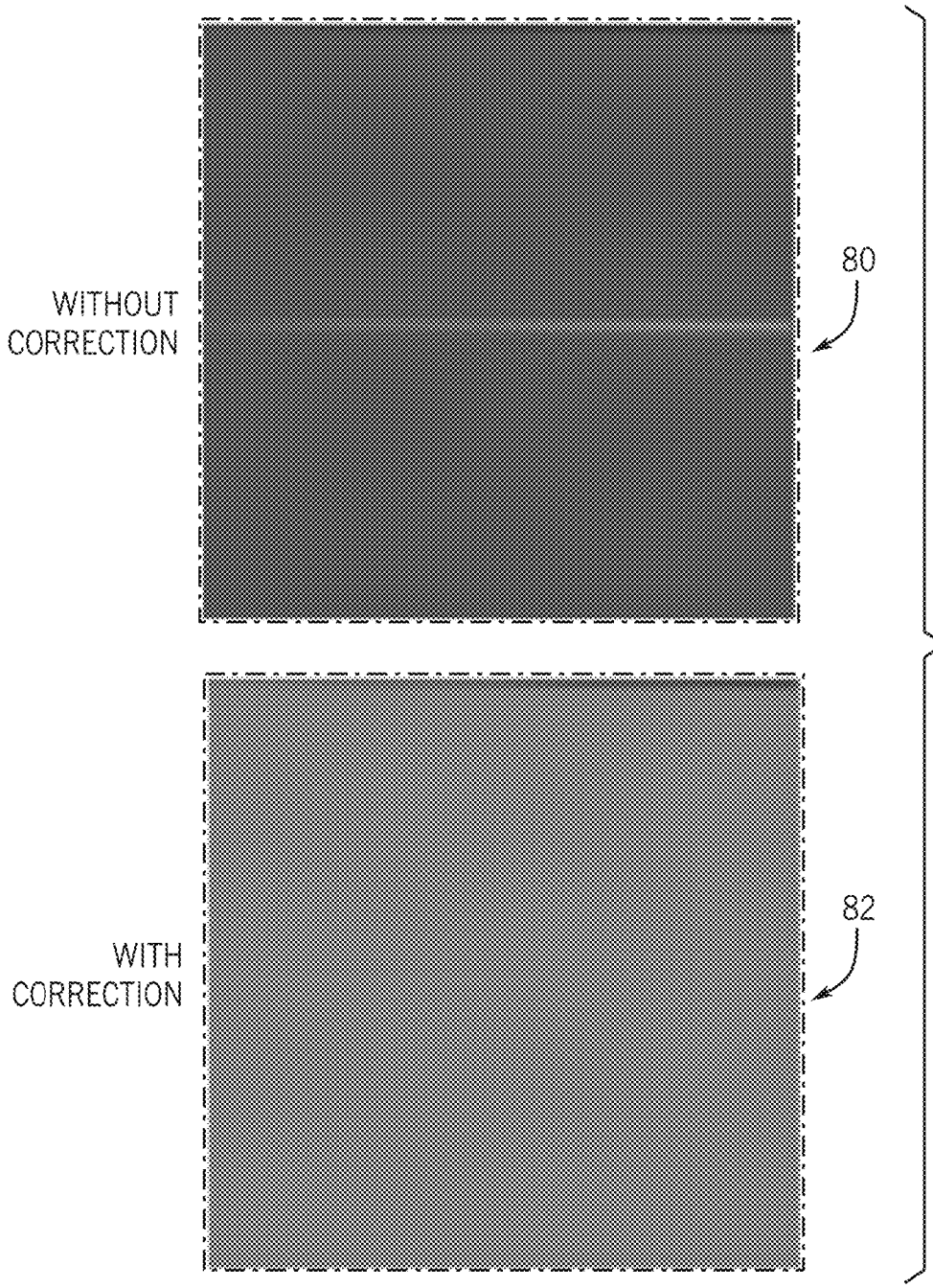
FIG. 7 is a schematic illustration depicting a tile boundary that is less visible on the electronic display of FIG. 1 after tile boundary compensation, in accordance with an embodiment of the present disclosure.

As discussed above, to compensate for a tile boundary, the image processing circuitry may adjust luminance of display pixels according to a gain mask or a point spread function. Accordingly, FIG. 7 is a schematic illustration depicting a tile boundary that is less visible on the tile-based display 46 after tile boundary compensation. Without tile boundary compensation, line 80 associated with the tile boundary is apparent on the tile-based display 46. However, after the tile boundary compensation, the line 80 associated with tile boundary is fully invisible or partially invisible. That is, the image content on the tile-based display 46 is displayed with a corrected tile boundary 82. The process for correcting display pixels to reduce visibility of a tile boundary will be described in greater detail below.

Figure 8:
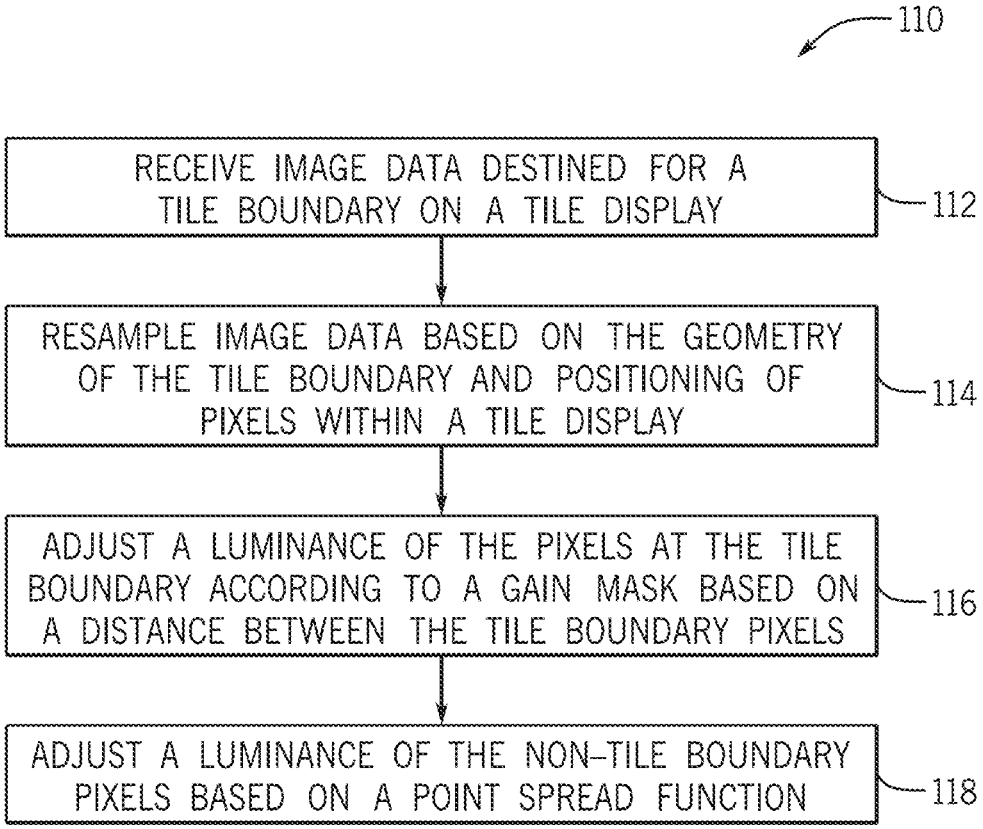
FIG. 8 is a flow diagram of a process for correcting the tile boundary of FIG. 7, in accordance with an embodiment of the present disclosure.

With the preceding in mind, FIG. 8 is a flow diagram of a process 110 for correcting a defective display pixel or reducing visibility of a tile boundary error on an electronic display, in accordance with an embodiment of the present disclosure. While the process 110 is described using steps in a specific sequence, it should be understood that the present disclosure contemplates that the described steps may be performed in different sequences than the sequence illustrated, and certain described steps may be skipped or not performed altogether. At block 112, processing circuitry (e.g., image processing circuitry, image compensation circuitry) may receive image data associated with displaying an image on a tile-based display. In some embodiments, the processing circuitry may, itself, generate image data. The image data may indicate display pixels that could result in a tile boundary when the tile-based display is operating (e.g., when the image is displayed on the tile-based display).

As mentioned above, the processing circuitry may generate the image data as an XY array. Because the image data is mathematically calculated, calculated locations of the display pixels according to the image data may not exactly match actual locations (e.g., physical locations) of the display pixels on the tile-based display. To account for this variance and ensure that the calculated locations of the display pixels according the image data match the actual locations of the display pixels on the tile-based display, the processing circuitry resamples the image data, at block 114. For example, according to the image data, a particular location on a tile-based display may include four display pixels. However, the actual number of pixels at the particular location of the tile-based display may be three display pixels. As such, the image data may be resampled to account for the actual number of pixels at the particular location on the tile-based display. As used herein, resampling of image data may involve changing (e.g., increasing, decreasing) the calculated number of display pixels at various locations on the tile-based display. The processing circuitry may resample data based on positioning of pixels on the tile-based display and geometry of the tile boundary (e.g., size, shape, number of display pixels associated with a gap between two tiles).

In some embodiments, the processing circuitry may resample the image data based on pixel arrangement of the tile-based display. If the tile-based display is arranged as a hexagonal grid, calculated locations of the display pixels based on the XY array may vary from the actual locations of the display pixels on the hexagonal grid of the tile-based display. As such, the processing circuitry may resample the image data to account for the actual locations of the display pixels on the hexagonal grid. However, if the tile-based display is arranged as a square grid, variance between the calculated locations of the display pixels according to the XY array and the actual locations of the display pixels on the square grid may be negligible. Accordingly, the processing circuitry may not resample the image data, thereby saving processing power.

As mentioned above, a tile boundary may be identified during manufacture, and location of the display pixels at the tile boundaries as well as distances between the display pixels at the tile boundaries may be stored in memory accessible to the processing circuitry. Based on the locations of the display pixels at the tile boundary as well as distances between the display pixels at the tile boundaries, a gain mask may be calculated during manufacture to calibrate the gain (e.g., increase gain, decrease gain) of the display pixels along the tile boundary to achieve a reduced gap. To compensate for the tile boundary, at block 116, the processing circuitry may acquire a gain mask that has been pre-programmed or calculated during manufacture from memory to perform a first order correction by adjusting gain (e.g., luminance) of tile boundary display pixels. That is, the processing circuitry may adjust the gain of the tile boundary pixels using the pre-programmed gain mask based on a distance between tile boundary display pixel and distance between non-tile boundary display pixels. A larger distance between tile boundary display pixels compared to a distance between non-tile boundary pixels may indicate a dark line appearing at the tile boundary or the tile boundary display pixels appearing dimmer than average. Accordingly, the processing circuitry may use a gain mask, in which gain at the tile boundary display pixels is increased, to perform the first order correction. In some embodiments, along with a first order correction at block 118, the processing circuitry may also perform a second order (or higher) correction based on the gain mask or a point spread function. The point spread function involves the distribution of luminance to surrounding display pixels from a point or location (e.g., tile boundary) on the tile-based panel. The processing circuitry may select a gain mask to reduce the gain at non-tile boundary display pixels to compensate for the increased gain at the tile boundary display pixels due to the first order correction.

Because locations of display pixels based on the gain mask (e.g., locations calculated based on algorithms, computer processes) may be different than physical locations of the tile boundary display pixels and non-tile boundary display pixels on the tile-based panel, total luminance of the image data after compensation of the tile boundary may be slightly different compared to the original luminance of the image data without the tile boundary. However, this slight change in luminance between the total luminance after compensation and the original luminance without the tile boundary may be less apparent than it otherwise would be or even may be imperceptible to the human eye. In some embodiments, the total luminance associated with the image data may not be changed despite compensating for point defects and distributing the target luminance of the defective display pixel to nearby non-defective display pixels.

Figure 9:
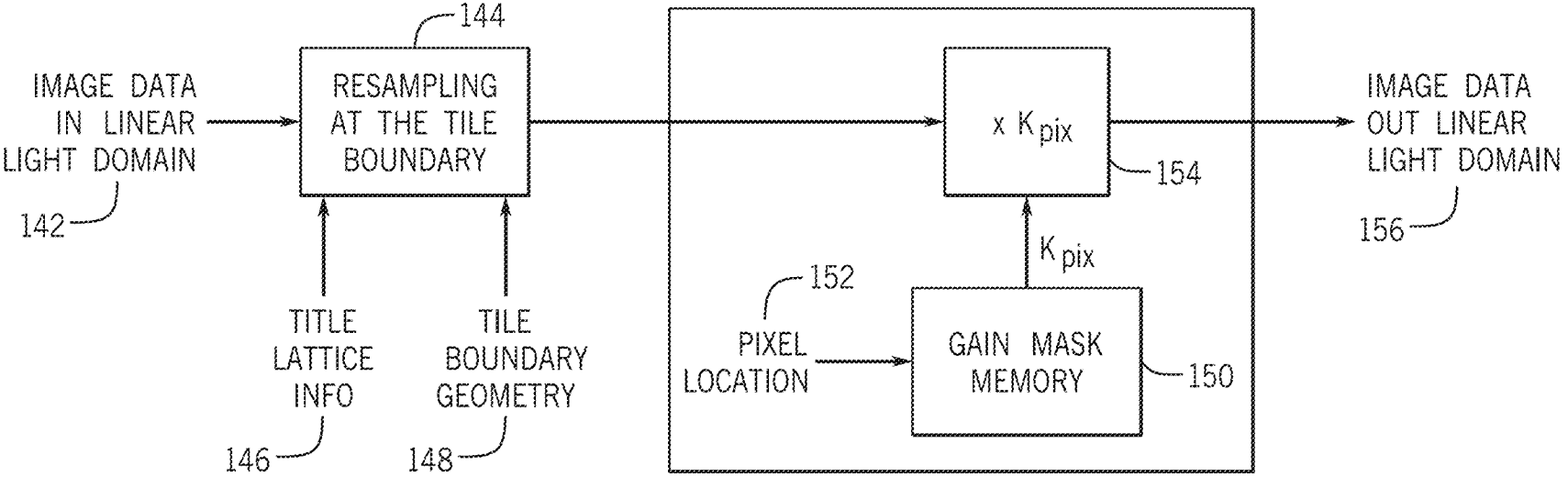
FIG. 9 is a block diagram of correcting the tile boundary of FIG. 7, in accordance with an embodiment of the present disclosure.

FIG. 9 is a block diagram associated with an image compensation system 140 for correcting tile boundaries on a tile-based display using a gain mask. As discussed above, processing circuitry of the tile-based display may receive image data associated with image content (e.g., images, videos) in a luminance domain (block 142). In some embodiments, the processing circuitry may generate image data associated with the image content in a gray level. In turn, the processing circuitry may convert the image data from the gray level to the luminance domain. Converting the gray level of the image data into the luminance domain helps the processing circuitry identify the original luminance of display pixels (e.g., luminance of display pixels at the tile boundaries).

In some embodiments, the processing circuitry may resample the image data (block 144) based on tile lattice information 146 and tile boundary geometry 148. The tile lattice information 146 may indicate the dimensions of each tile in the tile-based display. Further, the tile boundary geometry 148 may indicate the number of display pixels at a tile boundary, size and shape of a gap between two tiles, and so forth. Dimensions and measurements of tiles within the tile-based display as well as location of the display pixels may be obtained during manufacture. That is, during manufacturing, a computing device may capture an image of the tile-based display, and based on the image, the computing device may determine distances adjacent display pixels, locations of the display pixels, distances between tiles of tile-based display, and the like.

In some embodiments, before resampling the image data, the processing circuitry may determine the size of the gap between two tiles, where the gap results in the appearance of the tile boundary on the tile-based display. If the gap is greater than some threshold distance, the processing circuitry may resample the image data. However, if the gap is less than or equal to the threshold distance and/or the tile boundary is not visible, the processing circuitry may not resample the image data.

To compensate for the tile boundary, the processing circuitry may acquire a gain mask 150 that has been pre-programmed during manufacture to adjust the gain of display pixels along the tile boundary as well as display pixels that are not along the tile boundary based on the locations of the display pixels (block 152). According to the gain mask 150, a target luminance is distributed to the display pixels (block 154) on the tile-based display to compensate for the tile boundary. The gain at tile boundary display pixels and non-tile boundary display pixels may be adjusted based on first order and second order corrections, as discussed in FIGS. 10 and 11. In some embodiments, after adjusting the gain of display pixels according to the gain mask 150 to compensate for the tile boundary, the image data may continue to be operated in the luminance domain (block 156). In other embodiments, the processing circuitry may convert the image data from the luminance domain to the gray level.

Figure 10:
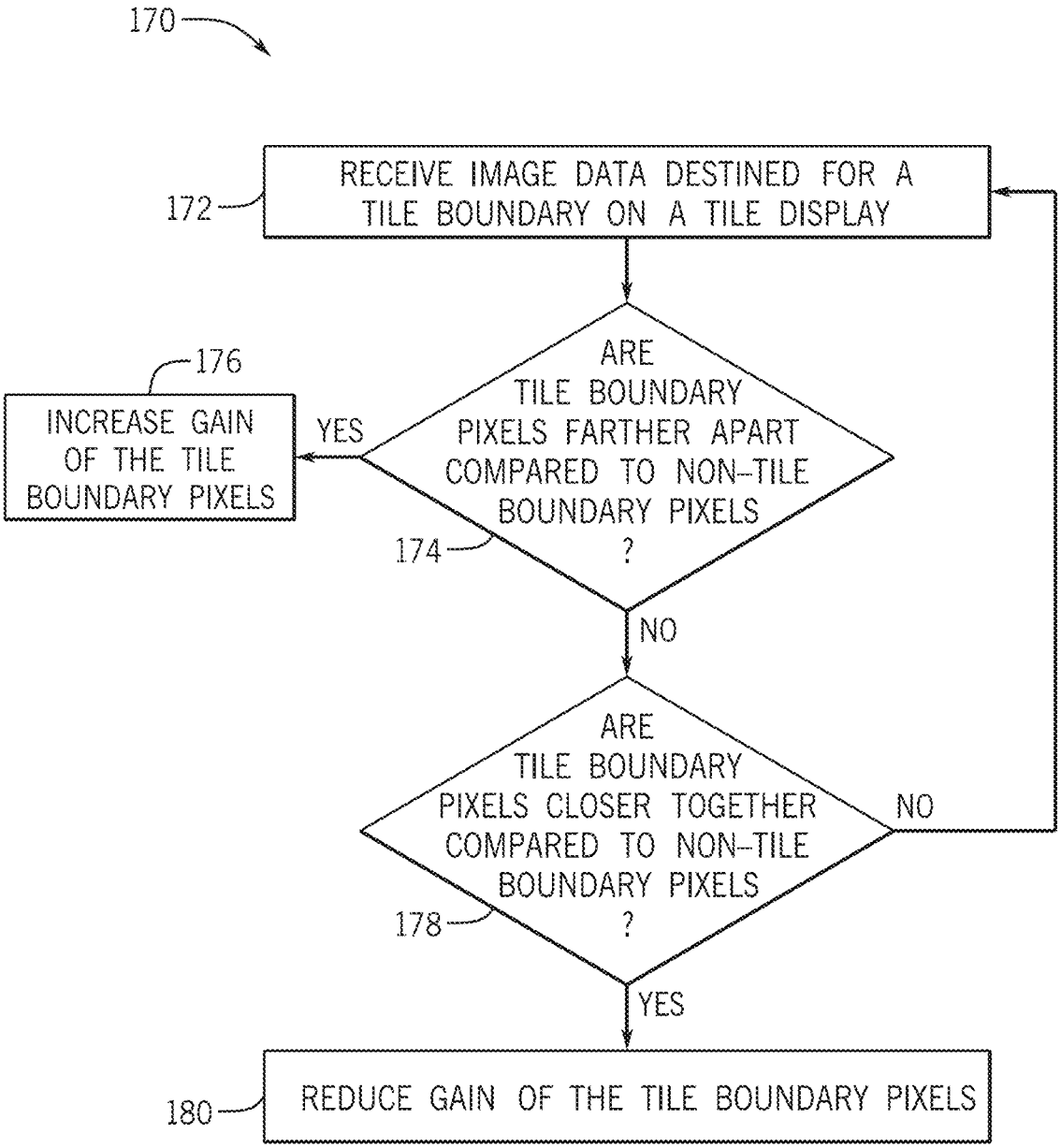
FIG. 10 is a flow diagram of a process for adjusting (e.g., increasing, decreasing) gain of tile boundary display pixels to correct the tile boundary of FIG. 7 based a distance between adjacent tile boundary display pixels, in accordance with an embodiment of the present disclosure.

With the preceding in mind, FIG. 10 is a flow diagram of the process 170 for adjusting (e.g., increasing, decreasing) gain of tile boundary display pixels based on determining a distance between adjacent tile boundary display pixels to correct a tile boundary. At block 172, processing circuitry may receive image data destined for a potential tile boundary on a tile-based display. As discussed above, the processing circuitry may adjust luminance of display pixels (e.g., the tile boundary display pixels) to compensate for the tile boundary by evaluating the distance between tile boundary display pixels. The processing circuitry acquires a suitable, pre-programmed gain mask based on the distance between tile boundary display pixels being greater than a distance between non-tile boundary display pixels, at block 174. In such cases where a gap between tiles at the tile boundary is larger than a gap between tiles that are not at the tile boundary, a dark line may appear at the tile boundary. Further, tile boundary display pixels may appear dimmer than the non-tile boundary display pixels despite having the same level of luminance as the non-tile boundary display pixels. To compensate for the dark line at the tile boundary, at block 176, the processing circuitry increases the gain (e.g., luminance) at the tile-boundary display pixels according to the suitable, pre-programmed gain mask. By increasing the gain of the tile-boundary display pixels, the gap between the tiles at the tile boundary may appear smaller.

If the display pixels at the tile boundary do not appear dimmer than the non-tile boundary display pixels (e.g., absence of a dark line at the tile boundary), at block 178, the processing circuitry acquires a gain mask suitable when the distance between tile boundary display pixels is less than a distance between non-tile boundary display pixels. In such cases where a gap between tiles at the tile boundary is smaller than a gap between tiles that are not at the tile boundary, a bright line appear at the tile boundary. Further, the tile boundary display pixels may appear brighter than the non-tile boundary display pixels despite having the same level of luminance as the non-tile boundary display pixels. To compensate for the closer together tile boundary display pixels compared to the non-tile boundary display pixels (e.g., causing the bright line at the tile boundary), at block 180, the processing circuitry decreases the gain at the tile-boundary display pixels according to the gain mask. By decreasing the gain of the tile boundary display pixels, the gap between the tiles at the tile boundary may appear smaller. As a result, the bright line at the tile boundary may be less apparent than it otherwise would be or even may be imperceptible.

Figure 11:
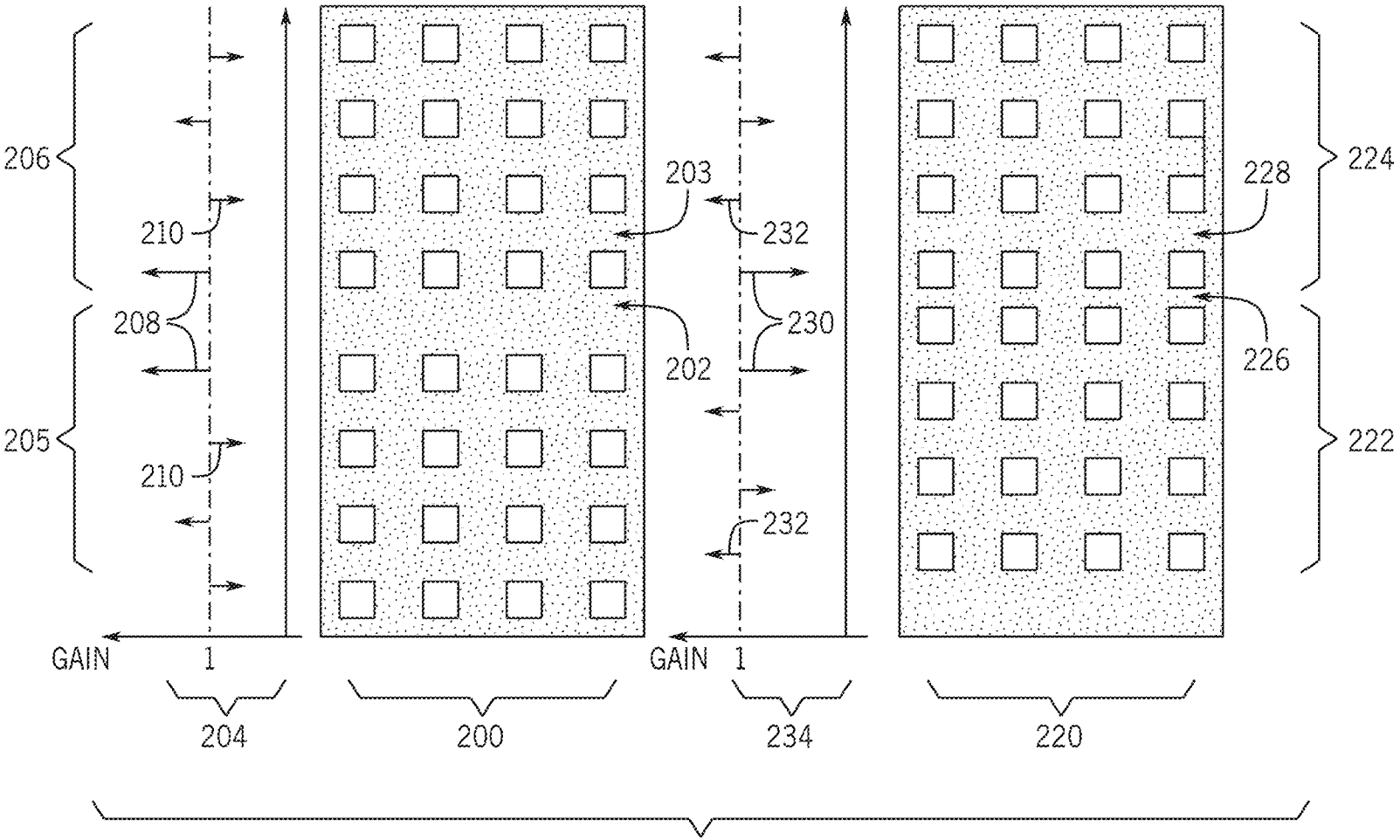
FIG. 11 is a schematic illustration depicting linear gain maps for respective tile boundaries associated with the electronic display of FIG. 1, in accordance with an embodiment of the present disclosure.

FIG. 11 is a schematic illustration depicting linear gain maps for correcting tile boundaries on respective tile-based displays. As illustrated, a tile-based display 200 has a gap 202 between tile boundary display pixels of tiles 205 and 206. Gap 202 is larger than gaps (e.g., gap 203) between non-tile boundary display pixels of both tiles 205 and 206. A larger gap 202 is indicates a dark line at the tile boundary or tile boundary display pixels (e.g., display pixels along the tile boundary) appearing dimmer to the human eye compared to the non-tile boundary pixels (e.g., display pixels not along the tile boundary). Accordingly, to compensate for the larger gap 202 and the dark line at the tile boundary, processing circuitry may perform a first order correction by increasing gain (e.g., luminance) at the tile-boundary display pixels as shown by arrows 208 on the linear gain map 204. By increasing gain of the tile-boundary display pixels, the dark line at the tile boundary may no longer be apparent to a viewer since the tile-boundary pixels may appear brighter. As such, after tile boundary compensation, the gap 202 may be reduced on the tile-based display.

In some embodiments, the processing circuitry may also perform a second order correction according to a 2D point spread function. The point spread function involves the distribution of luminance to surrounding display pixels from a point or location on the tile-based panel. If the luminance of the tile-boundary display pixels is increased, as indicated by arrows 210 on the linear gain map 204, the processing circuitry may reduce the gain at surrounding non-tile boundary display pixels. That is, to account for increased luminance at the tile-boundary display pixels due to the first order correction, the luminance of the non-boundary display pixels that are adjacent to the tile boundary display pixels may be reduced.

Further, a tile-based display 220 has a gap 226 between tile boundary display pixels of tiles 222 and 224. Gap 226 is smaller than gaps (e.g., gap 228) between non-tile boundary display pixels of both tiles 205 and 206. A smaller gap 226 is indicative of bright line at the tile boundary or tile boundary display pixels appearing brighter than non-tile boundary pixels to the human eye. Accordingly, to compensate the smaller gap 226 and the bright line at the tile boundary, the processing circuitry may perform a first order correction by decreasing gain at the tile-boundary display pixels as shown by arrows 230 on the linear gain map 234. By decreasing the gain of the tile-boundary display pixels, the bright line at the tile boundary may be less apparent. As such, after tile boundary compensation, the gap 226 may be enlarged on the tile-based display.

In some embodiments, the processing circuitry may also perform a second order correction according to a 2D point spread function. The point spread function involves the distribution of luminance to surrounding display pixels from a point or location on the tile-based panel. If the luminance of the tile-boundary display pixels is decreased, as indicated by arrows 232, on the linear gain map 234, the processing circuitry may increase the gain at surrounding non-tile boundary display pixels to account for decreased luminance at the tile-boundary display pixels due to the first order correction. It can be appreciated that the processing circuitry may perform any number of corrections to compensate for tile boundaries on tile-based displays. For example, the processing circuitry may perform a first order correction without performing a second order correction to compensate for tile-based displays.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device comprising:

an electronic display comprising an array of display pixels disposed over a plurality of tiles; and image processing circuitry configured to:

receive image data corresponding to image content;

resample at least some of the image data based on a geometry of a boundary between at least two tiles of the plurality of tiles; and perform a first order correction of the image data for a display pixel along the boundary by adjusting a luminance of the display pixel along the boundary according to a gain mask.

2. The electronic device of claim 1, wherein the gain mask is based on a distance between adjacent display pixels along the boundary.

3. The electronic device of claim 2, wherein when the distance between the adjacent display pixels along the boundary is greater than a distance between adjacent display pixels not along the boundary, the image processing circuitry is configured to perform the first order correction by increasing gain of the adjacent display pixels along the boundary according to the gain mask.

4. The electronic device of claim 2, wherein when the distance between the adjacent display pixels along the boundary is less than a distance between adjacent display pixels not along the boundary, the image processing circuitry is configured to perform the first order correction by reducing gain of the adjacent display pixels along the boundary according to the gain mask.

5. The electronic device of claim 1, wherein the electronic display comprises a tile-based display.

6. The electronic device of claim 1, wherein the image processing circuitry is configured to resample the image data based on a pixel arrangement of the electronic display.

7. The electronic device of claim 6, wherein the pixel arrangement of the electronic display comprises a hexagonal grid, a square grid, a rectangular grid, or any combination thereof.

8. The electronic device of claim 6, wherein the image processing circuitry is configured to resample the image data such that calculated positions of respective display pixels based on the image data are within a threshold distance of actual positions of respective display pixels on the electronic display according to the pixel arrangement.

9. The electronic device of claim 1, wherein the image processing circuitry is configured to perform a second order correction of the image data for a display pixel not along the boundary by adjusting a luminance of the display pixel not along the boundary according to the gain mask.

10. The electronic device of claim 1, wherein the image processing circuitry is configured to convert the display pixel along the boundary from a luminance domain to a gray level after performing the first order correction.

11. A system, comprising:

a tile-based display comprising a matrix of display pixels;

processing circuitry configured to generate image data to be displayed on the tile-based display; and tile boundary compensation circuitry configured to:

receive the image data from the processing circuitry;

perform a first correction of a tile boundary between two tiles of the tile-based display by adjusting a luminance of a plurality of tile boundary display pixels along the tile boundary according to a point spread function; and perform a second correction of the tile boundary by adjusting a luminance of a plurality of non-tile boundary display pixels adjacent to the plurality of tile boundary display pixels according to the point spread function, wherein when a distance between adjacent tile boundary display pixels is less than a distance between adjacent non-tile boundary display pixels, the tile boundary compensation circuitry is configured to:

perform the first correction by decreasing gain at the plurality of tile boundary display pixels according to the point spread function; and perform the second correction by increasing gain at the plurality of non-tile boundary display pixels that are adjacent to the plurality of tile boundary display pixels according to the point spread function.

12. The system of claim 11, wherein the processing circuitry is configured to resample the image data based on a pixel arrangement of the tile-based display.

13. The system of claim 12, wherein the pixel arrangement of the tile-based display comprises a hexagonal grid, a square grid, a rectangular grid, or any combination thereof.

14. The system of claim 13, wherein the processing circuitry is configured to resample the image data when the pixel arrangement comprises the hexagonal grid.

15. The system of claim 11, wherein the processing circuitry is configured to resample at least some of the image data based on a geometry of the tile boundary and respective positions of the plurality of tile boundary display pixels and the plurality of non-tile boundary display pixels.

16. The system of claim 11, wherein when a distance between adjacent tile boundary display pixels is greater than a distance between adjacent non-tile boundary display pixels, the processing circuitry is configured to:

perform the first correction by increasing gain at the plurality of tile boundary display pixels according to the point spread function; and perform the second correction by decreasing gain at the plurality of non-tile boundary display pixels that are adjacent to the plurality of tile boundary display pixels according to the point spread function.

17. The system of claim 11, wherein the processing circuitry is configured to perform the first correction and the second correction without changing a total luminance associated with the image data.

18. The system of claim 11, wherein the first correction comprises a first order correction, and wherein the second correction comprises a second order correction based on the first order correction.

19. A method, comprising:

generating or receiving, via a processing circuitry, image data for displaying image content on a display panel comprising a first tile and a second tile;

resampling, via the processing circuitry, at least some of the image data based on a geometry of a boundary between the first tile and the second tile; and performing, via the processing circuitry, an adjustment to the image data associated with at least one display pixel along the boundary between the first tile and the second tile by adjusting a luminance of the image data associated with the at least one display pixel along the boundary.

20. The method of claim 19, wherein the adjustment comprises a first order correction of the image data according to a gain mask.

21. The method of claim 20, comprising performing, via the processing circuitry, a second order correction of the image data associated with at least one display pixel not along the boundary by adjusting the luminance of the image data associated with the at least one display pixel not along the boundary according to the gain mask.

* * * * *